United States Patent [19]

Bouillet

[11] Patent Number: 4,659,908

[45] Date of Patent: Apr. 21, 1987

[54] ELECTRIC OVEN

[75] Inventor: André Bouillet, Cormelles-le-Royal, France

[73] Assignee: Moulinex, Societe Anonyme, Bagnolet, France

[21] Appl. No.: 844,781

[22] Filed: Mar. 27, 1986

[30] Foreign Application Priority Data

Apr. 5, 1985 [FR] France ..... 85 05250

[51] Int. Cl.[4] ..... F24C 7/06; H05B 1/02

[52] U.S. Cl. ..... 219/386; 99/337; 99/331; 126/275 E; 219/391; 219/521

[58] Field of Search ..... 219/385, 386, 387, 521, 219/391, 395, 396, 398, 405; 99/337, 338, 331; 126/192, 275 E

[56] References Cited

U.S. PATENT DOCUMENTS 2,262,910 11/1941 Aller ..... 99/331

2,907,859 10/1959 Walkoe ..... 219/391

3,845,272 10/1974 Schultz ..... 219/521

4,189,632 2/1980 Swanson ..... 219/391

*Primary Examiner*—E. A. Goldberg

*Assistant Examiner*—Teresa J. Walberg

*Attorney, Agent, or Firm*—Young & Thompson

[57] ABSTRACT

An electric oven has a number of heating elements for heating the cooking chamber. A multi-position switch is arranged to couple power to all of the heating elements, such that the chamber can be used as an oven, or to only selected heating elements such that a grilling operation can be performed. However, when grilling it is best if the door of the cooking chamber is at least partially open so that air can circulate.

The invention provides a mechanical linkage between the door and the switch such that if the switch is moved into its grill operating position, the door is automatically opened. In addition, if the door of the cooking chamber is closed, the switch is automatically moved into its oven operating position.

7 Claims, 5 Drawing Figures

ELECTRIC OVEN

BACKGROUND TO THE INVENTION

The present invention relates to electric ovens.

In particular, the invention relates to domestic ovens having a cooking chamber whose opening can be closed by a door and which contains at least one upper heating element and at least one lower heating element. Such ovens generally have a switch capable of assuming an oven operating position in which at least the lower element is energized, or a grill operating position in which only the upper element is energized.

When the oven is operated as a grill, its door should be left open so that air can circulate. When the device is to be used as an oven the door should be kept closed. Of course, the user, when operating the grill, may forget to leave the door open. This, not only impairs the quality of the grilling operation, which generally can only be performed successfully if the food to be grilled is adequately ventilated, but also risks causing either an abnormal increase in the temperature inside the cooking chamber since the upper element generally has a high output, or an interruption of the entire power supply because of the action of a thermostat.

It is an object of the invention to overcome these drawbacks.

SUMMARY OF THE PRESENT INVENTION

According to the present invention there is provided an electric oven comprising an enclosure defining a cooking chamber therein, an opening in said enclosure in communication with the chamber, and a door for closing said opening, said door being arranged to assume a first position, in which the opening is fully closed, and a second position, in which the door is partially open so that air can circulate into and out of the chamber through the opening, further comprising first and second electrical heating elements arranged within said cooking chamber, and switch-means for coupling the heating elements to power supply terminals, wherein said switch means is movable between a first, grill operating position, in which the power supply terminals are coupled to said first heating element, and a second, oven operating position, in which the power supply terminals are coupled to at least said second heating element, and further comprising movement transmission members cooperable with said switch means and with said door, said movement transmission members being arranged to ensure that movement of the switch means from its second position to its first, grill operating position, automatically causes the door to move from its first position to its second, partially open position.

With an oven of the invetion, the user himself no longer has to worry about placing the door in a suitable position for grilling.

BRIEF DESCRIPTION OF THE DRAWINGS

An embodiment of the present invention will hereinafter be described, by way of example, with reference to the accompanying drawings, in which.

DESCRIPTION OF A PREFERRED EMBODIMENT

The drawings show an electric domestic oven comprising a cooking chamber 12 whose front side is open. An upper heating element 14 and two lower heating elements 16 and 18 are housed within the chamber 12.

Figure 3:
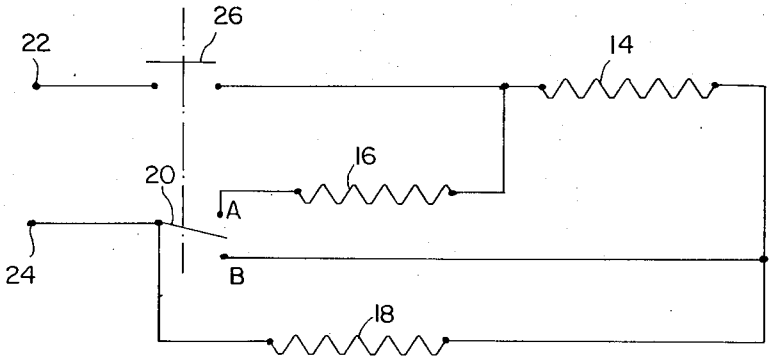
FIG. 3 shows a power supply circuit for heating elements of the oven.
Figure 5:
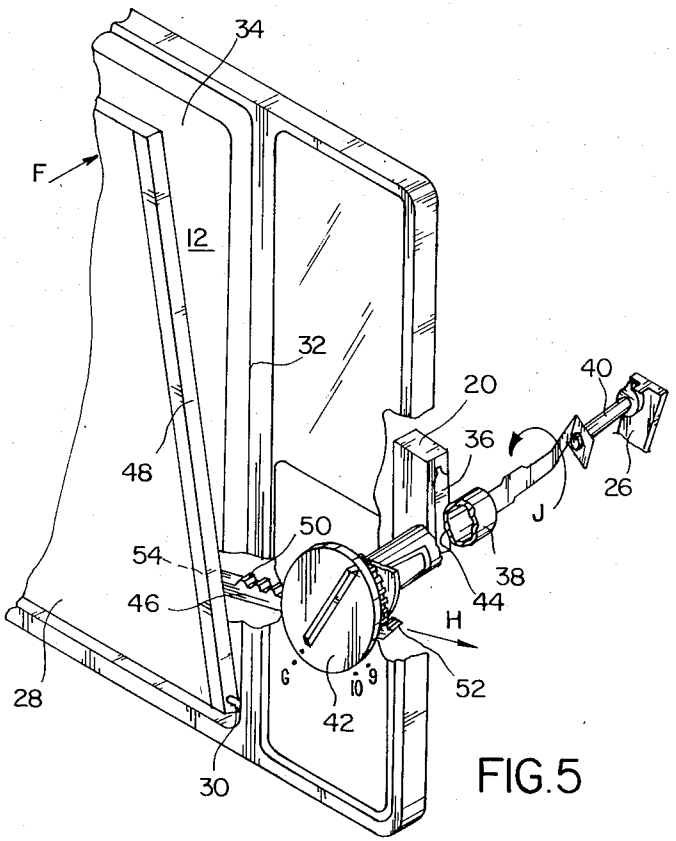
FIG. 5 is a similar view to FIG. 4 in a grill operating position.
Figure 4:
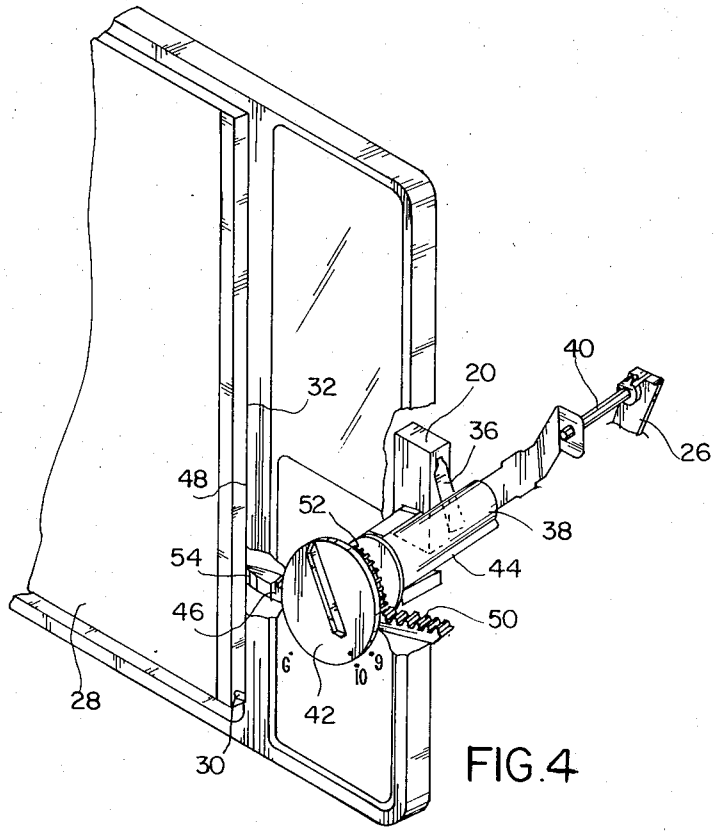
FIG. 4 is an enlarged perspective view of members arranged between a switch and a door of the oven, in an oven operating position.

The heating elements 14, 16, 18 are operated by way of a switch 20 (FIGS. 3 to 5) which is movable between an oven operating position (FIG. 4 and position A in FIG. 3) and a grill operating position (FIG. 5 and position B in FIG. 3). In the oven operating position A of switch 20, the heating element 16 is connected in parallel with the series connection of the elements 14 and 18, and are supplied by the mains voltage applied to input terminals 22 and 24. In the grill operating position B, only the upper heating element 14 is connected to the terminals 22 and 24 and energized. In both the oven operating position and the grill operating position, the supply voltage is applied to the heating elements by way of a thermostatic switch 26 (only a portion of which is shown in FIGS. 4 and 5) which is intended to regulate the temperature within the cooking chamber 12.

Figure 2:
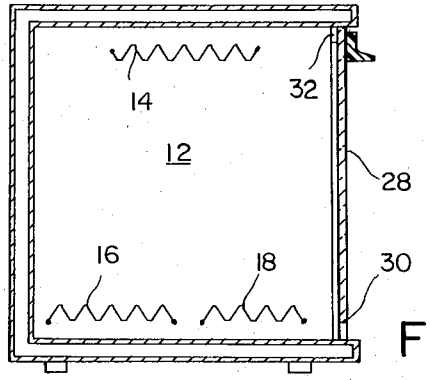
FIG. 2. shows diagrammatically the oven of FIG. 1 in vertical cross-section.
Figure 1:
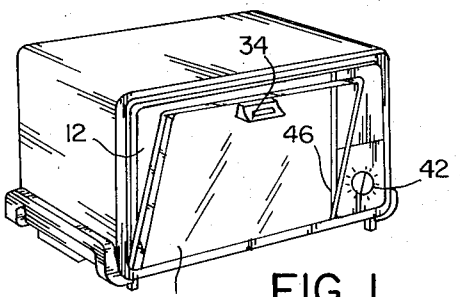
FIG. 1 is a perspective view of an electric domestic oven of the invention.

The cooking chamber 12 is provided with a door 28 arranged at its front side and hinged about a horizontal pin 30 located in the vicinity of the bottom edge of the door 28. The door is able to assume a closed position (FIGS. 2 and 4) in which it is pressed against the frame 32 of the front opening, or a half-open position (FIGS. 1 and 5) in which the door defines with the frame 32 a space 34 allowing air to circulate between the chamber 12 and the exterior.

The switch 20 for operating the heating elements is actuated by a movable contact 36. This contact 36 is itself operated by a rotatable spindle 38 coupled to the adjusting spindle 40 of the thermostatic switch 26.

The spindle 38 is provided with a control knob 42 and also has a lateral projection 44. At a given angular position, the projection 44 is arranged to actuate the contact 36 to put the switch 20 into its grill operating position B. The angular position of the projection 44 corresponds to an angular position of the knob 42, indicated by the letter G, which is shown in FIG. 5. In FIG. 5, the spindle 38 is shown partially cut-away so that the projection 44 is clearly visible. It will be noted from FIG. 5, that when the spindle 38 has been rotated to put the switch 20 in its grill operating position, the adjusting spindle 40 ensures that the thermostatic switch 26 is in a permanently closed position.

For any other angular position of the spindle 38 other than that in which its knob 42 is aligned with the letter G, the projection 44 releases the contact 36 and thus leaves the switch 20 in its oven operating position A. The thermostatic switch 26 is also released so that it is able to act to regulate the temperature in the chamber 12 to that required. The required temperature is set by turning the knob 42 to position it opposite a selected one of the numbered reference marks, for example, see marks 10, 9 shown in FIGS. 4 and 5.

Movement transmission members are arranged between the switch 20 and the door 28 and are arranged to ensure that when the switch 20 is moved from its oven operating position A to its grill operating position B the door 28 is automatically caused to move from its closed position, FIG. 4, to its half-open position, FIG. 5.

The movement transmission members comprise a door opener 46 movably mounted on the frame 32 of the front opening of the chamber and mechanically linked to the operating spindle 38 of the switch 20. When the switch 20 is in its oven operating position, FIG. 4, the door opener 46 is in a rest position in which, it is retracted and allows the door 28 to assume its closed position. When the switch 20 is switched to its grill operating position, FIG. 5, the door opener 46 moves into an active position in which it is positioned between the frame 32 and the lateral edge 48 of the door 28 and acts to cause the door 28 to pivot outwardly into its half-open position. The door opener 46, in its active position, also acts to keep the door 28 in its half-open position.

As be can seen in FIGS. 4 and 5, the door opener 46 comprises a sliding rack, the teeth 50 of which are engaged with a toothed wheel 52 integral with the operating spindle 38. One pointed free end of the rack has an inclined ramp 54 arranged to engage between the edge 48 of the door 28 and the frame 32 when the rack moves into its active position.

If, when the switch 20 is in its grill operating position (FIG. 5), the user exerts a pressure (arrow F) on the door 28 to try to move it from its half-open position into its closed position, the edge 48 of the door will co-operate with the inclined ramp 54 so as to move the rack 46 in the direction of arrow H into its rest position. This movement rotates the spindle 38 as indicated by arrow J, and so the switch 20 is switched from its grill operating position into its oven operating position (reference mark 10).

Thus, the transmission members, arranged between the switch 20 and the door 28 and comprising the spindle 38, the toothed wheel 52, the rack 46 and the ramp 54, are arranged to ensure not only that swiching of the switch 20 to its grill operating position causes the door to move into its half-open position, but also, conversely, that when the door returns to its closed position, the swtich 20 is switched to its oven operating position.

The user therefore does not have to worry about placing the door 28 in a suitable position for grilling, since this operation is performed automatically. He also does not have to worry about setting the knob 42 when it is required to return to the oven operating position, since this operation is also performed automatically.

I claim:

1. An electric oven comprising an enclosure defining a cooking chamber therein, an opening in said enclosure in communication with the chamber, and a door for closing said opening, said door being arranged to assume a first position, in which the opening is fully closed, and a second position, in which the door is partially open so that air can circulate into and out of the chamber through the opening, further comprising first and second electrical heating elements arranged within said cooking chamber, and switch means for coupling the heating elements to power supply terminals, wherein said switch means is movable between a first, grill operating position, in which the power supply terminals are coupled to said first heating element, and a second, oven operating position, in which the power supply terminals are coupled to at least said second heating element, and further comprising movement transmission members cooperable with said switch means and with said door, said movement transmission members being arranged to ensure that movement of the switch means from its second position to its first, grill operating position, automatically causes the door to move from its first position to its second, partially open position.

2. An oven according to claim 1, wherein said movement transmission members comprise a door opener movably mounted on the enclosure and mechanically linked to said switch means such that when the switch means is in its second, oven operating position, the door opener is in a rest position in which it allows the door to assume its first, closed position, and wherein, when the switch means is moved to its first, grill operating position, the door opener moves into an active position in which it is arranged between the door and the enclosure so as to bring the door into its second, partially open position.

3. An oven according to claim 2, wherein said switch means comprises a mechanical switch, a rotatable spindle arranged to operate the switch, and a toothed wheel rotationally fixed to said spindle, and wherein the door opener comprises a slidable rack having a plurality of teeth and a free end having an inclined ramp surface, the toothed wheel of the switch means being engaged with the teeth of the door opener, and the inclined ramp surface of the door opener being arranged to engage between the door and the opening when the door is moved into its active position.

4. An oven according to claim 3, wherein the rotatable spindle of the switch means carries a lateral projection arranged, when the spindle assumes a given angular position, to actuate the switch means to bring it into its first, grill operating position.

5. An oven according to claim 4, further comprising a thermostatic switch coupled to the power supply terminals and arranged to regulate the supply of power to the heating elements, and hence the temperature of the cooking chamber, and an adjusting spindle for the thermostatic switch, said adjusting spindle being coupled to the rotatable spindle of the switch means such that, when the switch means is in its first position, the adjusting spindle keeps the thermostatic switch closed, and when the switch means is in its second position, the thermostatic switch is released.

6. An oven according to claim 1, wherein said movement transmission members are also arranged to ensure that when the door moves from its second position to its first, closed position, said switch means is automatically switched from its first position to its second, oven operating position.

7. An oven according to claim 3, wherein when the door moves from its second position to its first, closed position, an edge of the door co-operates with the inclined ramp so as to bring the rack into its rest position and thus cause the switch to be switched from its first position to its second, oven operating position.

* * * * *